US005080610A

United States Patent [19]

Kanaya et al.

[11] Patent Number: 5,080,610

[45] Date of Patent: Jan. 14, 1992

[54] APPARATUS FOR FIXING A HALOGEN LAMP

[75] Inventors: Yoshihiro Kanaya; Makoto Morishima, both of Nagoya, Japan

[73] Assignee: Rinnai Kabushiki Kaisha, Japan

[21] Appl. No.: 524,203

[22] Filed: May 16, 1990

[30] Foreign Application Priority Data

May 31, 1989 [JP] Japan ..... 1-63643[U]

[51] Int. Cl.[5] ..... H01K 3/00

[52] U.S. Cl. ..... 439/562; 439/612; 445/22

[58] Field of Search ..... 445/22, 29, 27; 174/152 R, 152 G; 439/612, 562

[56] References Cited

U.S. PATENT DOCUMENTS

| | | | |
|---|---|---|---|
| 2,269,076 | 1/1942 | Boll | 174/152 G |
| 2,617,002 | 11/1952 | Hasley | 174/152 R |
| 3,005,039 | 10/1961 | Abrams | 174/152 R |
| 4,752,710 | 6/1988 | Devir et al. | 439/611 |
| 4,928,210 | 5/1990 | Hayakawa et al. | 439/612 |

*Primary Examiner*—Kenneth J. Ramsey

*Attorney, Agent, or Firm*—Nilsson, Robbins, Dalgarn, Berliner, Carson & Wurst

[57] ABSTRACT

There is disclosed an apparatus for fixing a halogen lamp (1) characterized in that a spacer (11) of fluorocarbon resin is mounted on an insulator portion of the halogen lamp (1) and that the halogen lamp (1) is fixed to a metallic fixing member (10) through the spacer (11).

2 Claims, 2 Drawing Sheets

APPARATUS FOR FIXING A HALOGEN LAMP

This invention relates to an apparatus for fixing a halogen lamp which is used as a heat source, for example, of a cooking device.

A halogen lamp a is a kind of incandescent lamp and can be classified into a double-base type of construction as shown in FIG. 5 and a single-base type of construction as shown in FIG. 6. In both constructions the insulator portion b is fixed to a bulb c with an adhesive d of ceramic type.

In this halogen lamp a, it is normal practice to have it fixed to a metallic fixing member e of a cooking device main body at the insulator portion b, as shown in FIG. 4 or FIG. 6.

Since the above-mentioned adhesive d of ceramic type is porous, the moisture is likely to be entrained thereinto, and with the rise in temperature the electrical resistance value decreases, thereby resulting in an easier electrical current flow therethrough.

On the other hand, the above-mentioned insulator b is likely to give rise to dewing on its surface, and with the rise in temperature the electrical resistance value decreases, thereby resulting in an easier electrical current flow therethrough.

Therefore, according to the convention method of fixing as mentioned above, in either of the constructions, a leaking electrical current is likely to flow at the initial time of current flow when the temperature is low, through a lead-in wire f, the adhesive d of ceramic type and the dew on the surface of the insulator b towards the metallic fixing member e. In a live condition, when the temperature is high, a leaking electrical current as mentioned above is likely to flow due to a decrease in the resistance value; in any case there is a disadvantage in that a leaking electrical current is likely to occur. In these Figures, reference character g denotes an electric cap.

This invention solves the above-mentioned disadvantage and is characterized in that, in an apparatus for fixing a halogen lamp, a spacer of fluorocarbon resin is mounted on an insulator portion of the halogen lamp and that the halogen lamp is fixed to a metallic fixing member through the spacer.

According to this invention, which has the above-mentioned construction, even if a leaking electrical current flows from the lead-in wire to the surface of the insulator due to the moisture in the adhesive of ceramic type and to moisture on the surface of the insulator at the initial time of current flow to the halogen lamp when the temperature is low, as well as due to the decrease in the resistance value of the adhesive of ceramic type and of the insulator in the live condition when the temperature is high, this electric current is stopped by the water repellent and electrically insulating characteristics of the spacer of fluorocarbon resin at the low temperature, and stopped by the heat resistivity and the electrically insulating characteristics of the spacer of fluorocarbon resin at the high temperature and, therefore, the leaking electrical current does not flow to the metallic fixing element.

An embodiment of this invention as applied to a halogen lamp of double-base type of construction is described with reference to FIGS. 1 to 3 of the drawings in which.

Figure 1:
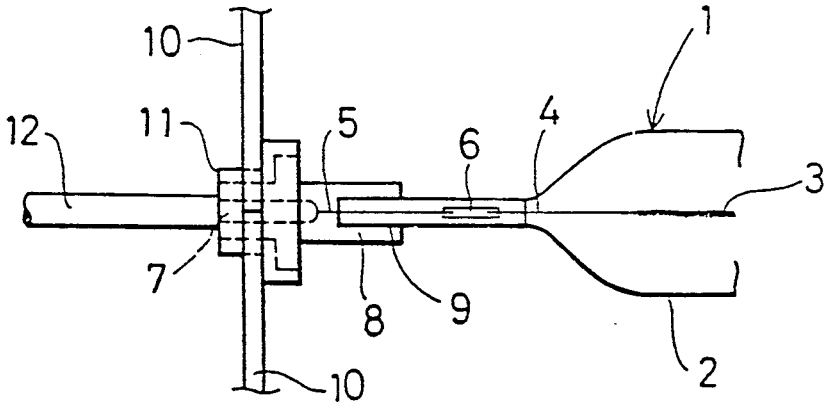
FIG. 1 is a side view of an important portion of an embodiment of this invention as applied to a halogen lamp of double-base type of construction.
Figure 3:
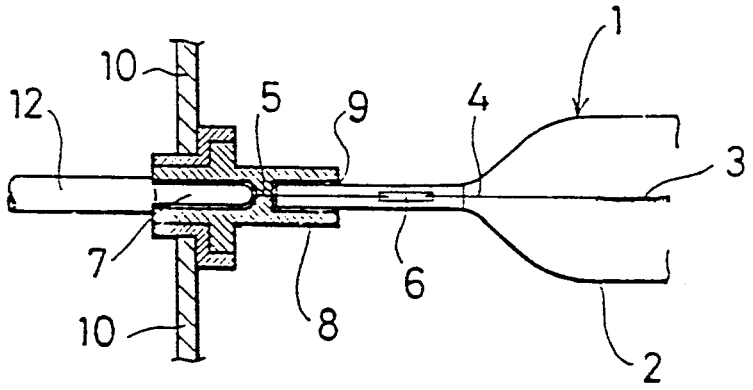
FIG. 3 is a side view, partly in section, of the important portion shown in FIG. 1.
Figure 4:
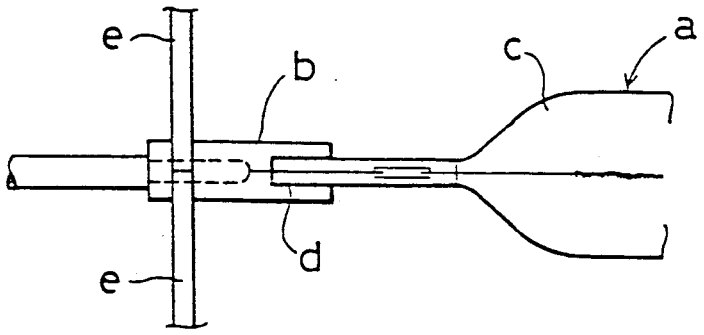
Figure 2:
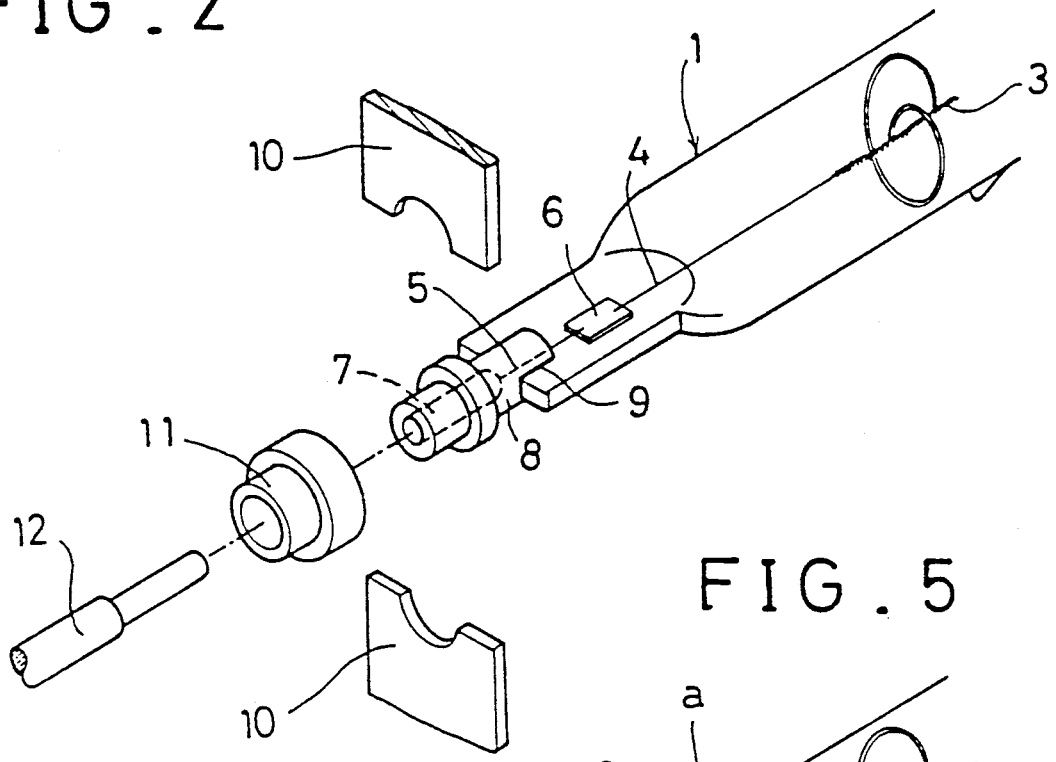
FIG. 2 is an exploded perspective view of the important portion shown in FIG. 1.
Figure 5:
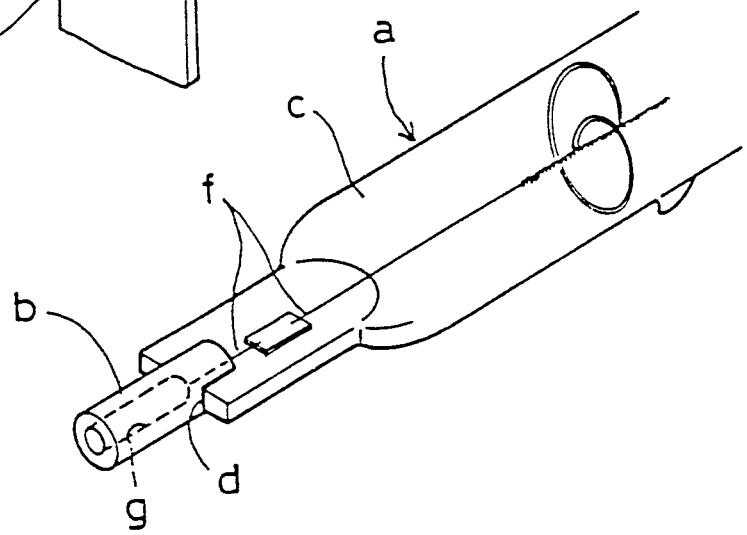
Figure 6:
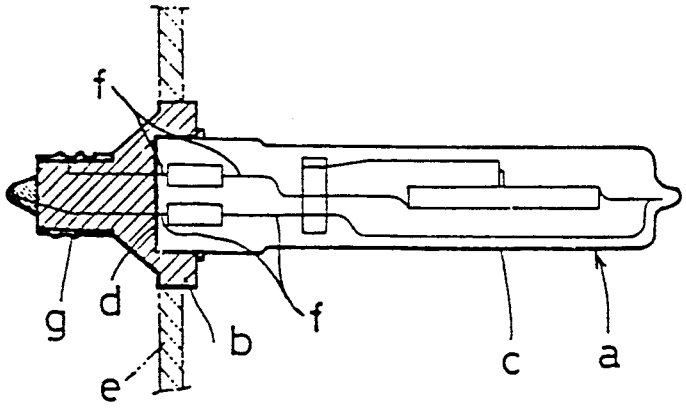

As noted above:

FIG. 4 is a side view of an important portion of a conventional example;

FIG. 5 is a perspective view of a conventional halogen lamp of double-base type of construction; and FIG. 6 is a side view, partly in section, of a conventional halogen lamp of single-base type of construction.

The halogen lamp 1 of the double-base type of construction has a bulb 2, a filament 3, an internal lead-in wire 4 connected to the filament 3, an external lead-in wire 5, a molybdenum foil 6 to connect the lead-in wires 4 and 5, a base 7 connected to the external lead-in wire 5, an insulator 8 to cover the base 7, and the like. The insulator 8 and the bulb 2 are connected together with an adhesive 9 of ceramic type. Inside the bulb 2 there is sealed a halogen substance such as iodine, bromine, chlorine, etc. to prevent blackening thereof.

The halogen lamp 1 is conventionally fixed, when used as a heat source in an electric oven, by insulators 8, 8 on both ends thereof for fixing to metallic fixing members 10, 10 of the oven main body (not shown). This construction, however, is not preferable because it is likely to give rise to a leaking electrical current as described above. Therefore, in this invention, a spacer 11 made of fluorocarbon resin is disposed in the portion of the insulator 8 and the halogen lamp 1 is fixed to the metallic fixing members 10, 10 through the spacer 11 so that no leaking electrical current occurs.

This is now explained in more detail. The spacers 11,11 are constituted by tubes made of fluorocarbon resin which has water repelling, heat resisting, and electrically insulating characteristics. They are inserted over the respective insulators 8, 8 at both ends so as to externally cover them, thus fixing the halogen lamp 1 to the metallic fixing members 10, 10 at the spacers 11, 11.

In this construction, even if a leaking electrical current is made to flow at the initial time of current flow to the halogen lamp when the temperature is low, through the moisture entrained to the adhesive 9 of ceramic type as well as through the dew generated on the surface of the insulator 8 from the external lead-in wire 5, this electrical current is stopped by electrically insulating characteristic of, and the water repellant characteristic with which water hardly adheres to the surface of, the above-mentioned spacer 11. In a live condition, when the temperature is high, even if a leaking electrical current is made to flow through the adhesive 9 of ceramic type of reduced resistivity value and through the insulator 8 from the external lead-in wire 5, this electrical current is stopped by the heat resistivity and the electrically insulating characteristic of the spacer 11. Therefore, since in either of the cases the electrical current does not reach the metallic fixing member 10, there is no leakage of electrical current. Further, the above-mentioned spacer 11 has a shock absorbing function between the metallic fixing member 10 and the insulator 8.

In the Figures, reference numeral 12 denotes a lead-in wire one end of which is inserted into the base 7 of the halogen lamp 1 and, in case of a halogen lamp without the base 7, the lead-in wire 12 is directly connected to the external lead-in wire 5.

In the above embodiment, the spacer 11 of fluorocarbon resin is constituted by a tube of fluorocarbon resin. However, it is not limited to the tube; any shape is acceptable as long as it can be interposed between the insulator 8 of the lamp and the metallic fixing member 10.

Further, although the halogen lamp 1 of the above embodiment is of double-base type of construction, this invention can also be applied to a single-base type of construction.

As described above, according to this invention, since the halogen lamp is fixed to the metallic fixing member through a spacer of fluorocarbon resin, a leaking electrical current does not flow from the side of the halogen lamp to the metallic fixing member even if dew is formed on the insulator or the resistivity value thereof is decreased. Therefore, it has an effect that the disadvantage of the occurrence of a leaking electrical current can be eliminated.

We claim:

1. A lamp assembly comprising a halogen lamp having an insulator portion and means for fixing said halogen lamp to a metallic member, said fixing means comprising an aperture within said metallic member adapted to surround the insulator portion of said halogen lamp, a spacer of fluorocarbon resin mounted on the insulator portion of said halogen lamp and formed to engage the aperture of said metallic member.

2. The assembly of claim 1 wherein said spacer is constituted by a tube of fluorocarbon resin.

* * * * *